US005503312A

United States Patent [19]

Kassner

[11] Patent Number: 5,503,312

[45] Date of Patent: Apr. 2, 1996

[54] PORTABLE-TRAVEL-STORAGE-STYLING WIG CAGE

[76] Inventor: Gary Kassner, 4416 Indiana Ave., La Cañada, Calif. 91011

[21] Appl. No.: 372,989

[22] Filed: Jan. 17, 1995

[51] Int. Cl.[6] ..... A41H 5/00; A47F 5/14; F16M 11/12

[52] U.S. Cl. ..... 223/120; 223/1; 211/182; 211/33; 248/165

[58] Field of Search ..... 211/33, 182, 113; 248/163.1, 183, 165; 223/120, 24, 25, 26–84

[56] References Cited

U.S. PATENT DOCUMENTS

| | | | |
|---|---|---|---|
| 25,730 | 6/1896 | Whayne | 248/163.1 |
| 1,412,126 | 4/1922 | Mansell-Phayre | 211/33 |
| 1,972,018 | 8/1934 | Johnson | 211/33 |
| 3,289,822 | 4/1965 | Schumer | 223/66 |
| 3,289,823 | 2/1966 | Weiser | 223/66 |
| 3,327,842 | 9/1967 | Merideth et al. | 223/66 |
| 3,448,957 | 6/1969 | Friedman | 223/66 |
| 3,464,603 | 9/1969 | Hunter | 223/66 |
| 3,465,926 | 9/1969 | Schwartz et al. | 223/66 |
| 3,465,927 | 9/1969 | Belokin | 223/66 |
| 3,489,383 | 1/1970 | Anson | 223/66 |
| 3,503,581 | 3/1970 | Rouleau | 223/66 |
| 3,515,318 | 6/1970 | Preble | 223/66 |
| 3,580,437 | 5/1971 | Luco | 223/66 |
| 3,596,863 | 8/1971 | Kaspareck | 223/66 |
| 3,603,489 | 9/1971 | Fleischer | 223/66 |
| 3,615,046 | 10/1971 | Bashara | 223/66 |
| 3,658,174 | 4/1972 | Friedman | 223/66 |
| 3,658,283 | 4/1972 | Martin | 223/66 |
| 3,713,566 | 1/1973 | Perez | 223/66 |
| 3,740,014 | 6/1973 | Bently et al. | 223/66 |
| 3,741,448 | 6/1973 | Friedman | 223/66 |
| 3,750,869 | 8/1973 | Kartiganer | 223/66 |
| 3,885,718 | 5/1975 | Clemence | 223/66 |
| 3,934,804 | 1/1976 | Bruce | 223/66 |
| 3,935,871 | 2/1976 | Kern | 223/66 |
| 3,999,727 | 12/1976 | Renneman | 211/182 |
| 4,422,230 | 9/1981 | Nemoto | 223/66 |
| 4,470,528 | 7/1983 | La | 223/66 |
| 4,616,747 | 9/1985 | Zimmerman | 223/66 |
| 4,691,885 | 9/1987 | Lawrence | 248/165 |
| 5,218,904 | 6/1993 | Loveland | 100/295 |
| 5,257,794 | 11/1993 | Nakanwa | 211/182 |
| 5,377,849 | 1/1995 | Martin | 211/182 |

*Primary Examiner*—C. D. Crowder
*Assistant Examiner*—Bibhu Mohanty

[57] ABSTRACT

A portable cage device for transport, storage and styling is disclosed which has application to wigs, hairpieces and hats. The structures in accordance with the invention uses a cage structure to establish adequate support, protection and a structure for manipulating head form to top of cage to accomplish styling of a wig. A vertical neck lever is pivoted with in the cage to a position on top of cage to become a sturdy styling stand. The cage structure is portable and compact. This invention arrangement allows for easy observation of a styled or unstyled wig or hat while simultaneously providing protection and support. The cage structure is lightweight, strong, easily assembled and/or disassembled for storage and/or shipping. The cage also allows for custom modification of cage dimensions. Assembly of cage requires no special tools, skills or materials.

1 Claim, 4 Drawing Sheets

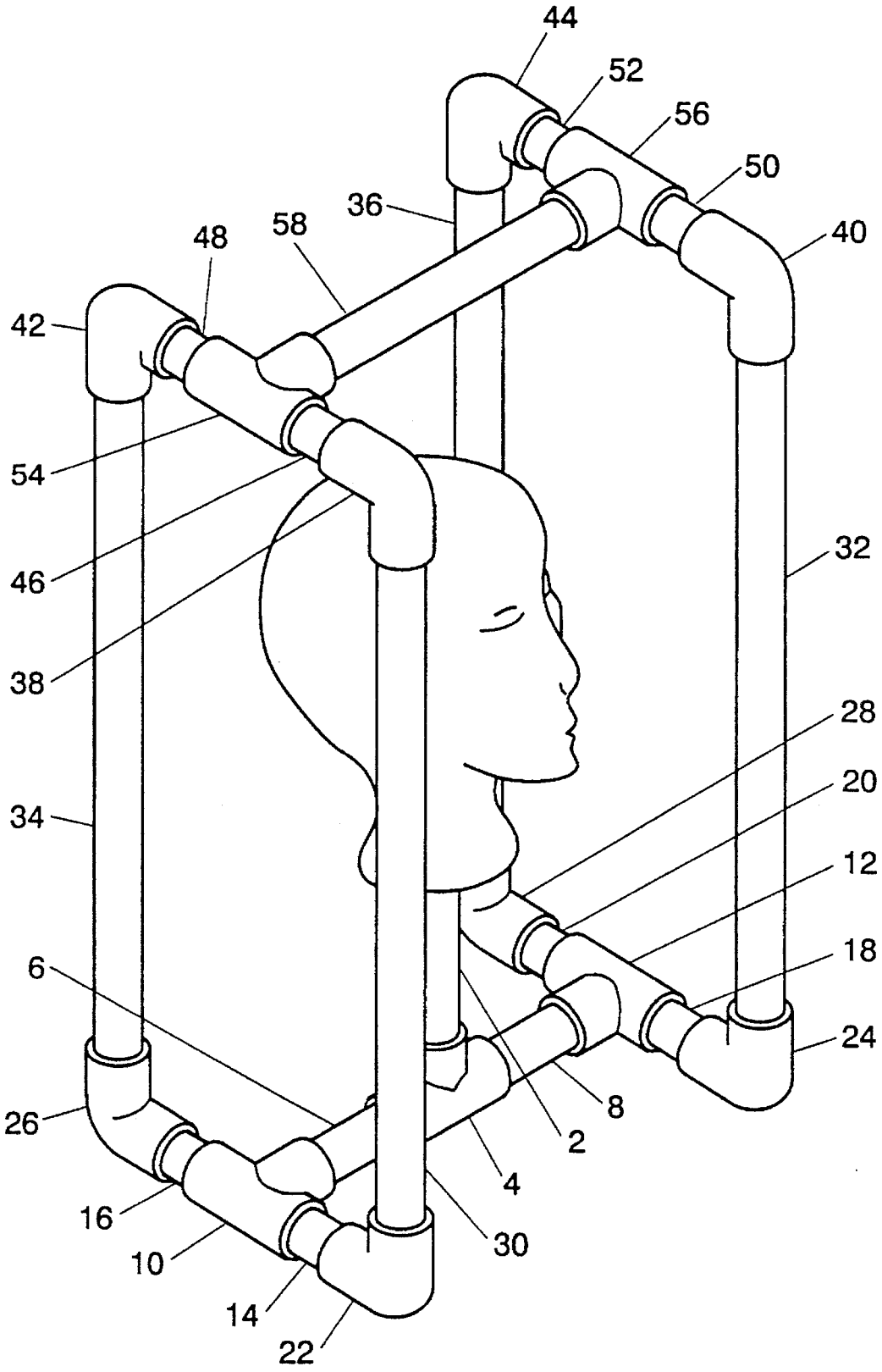
Fig. 1-A

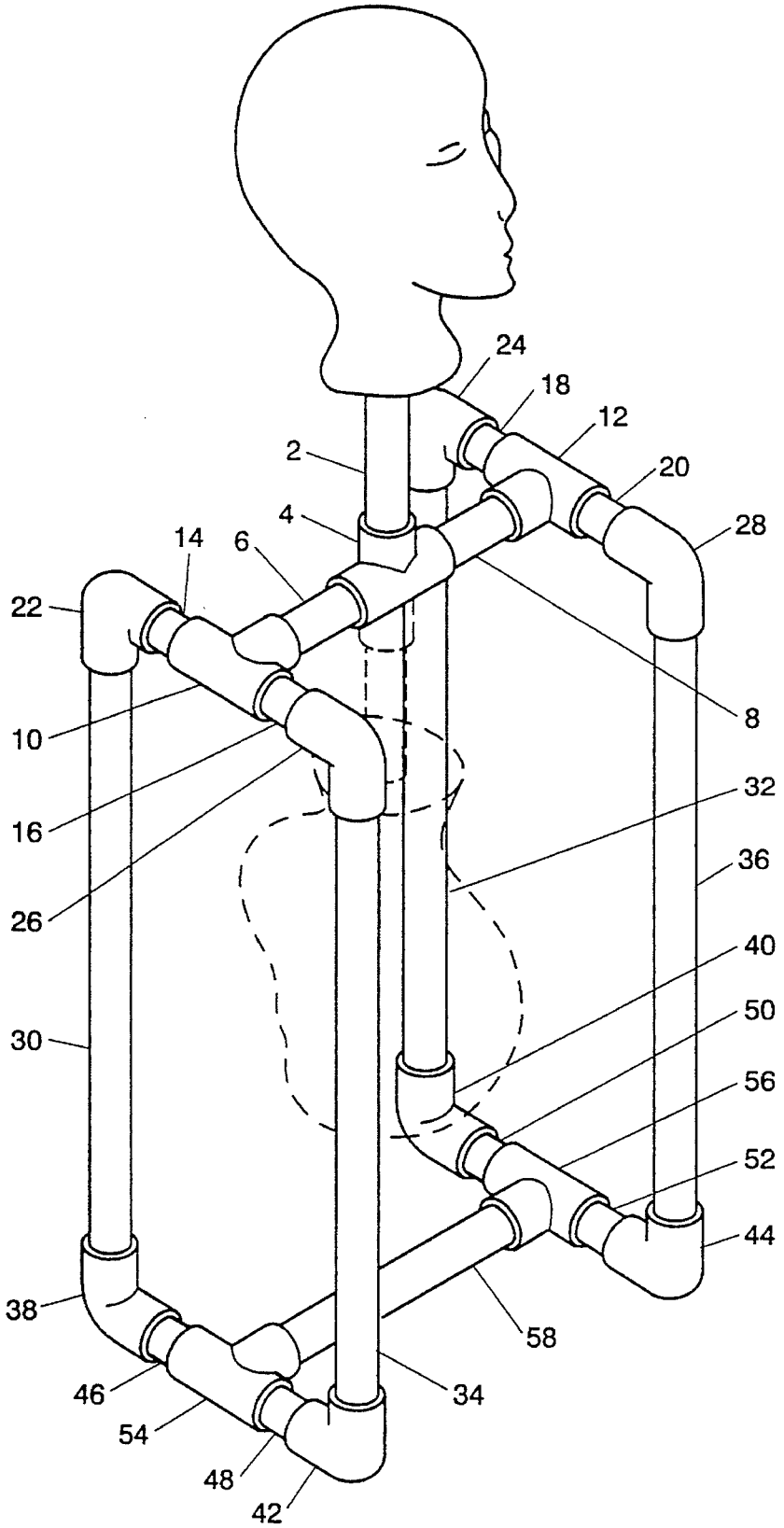
Fig. 1-B

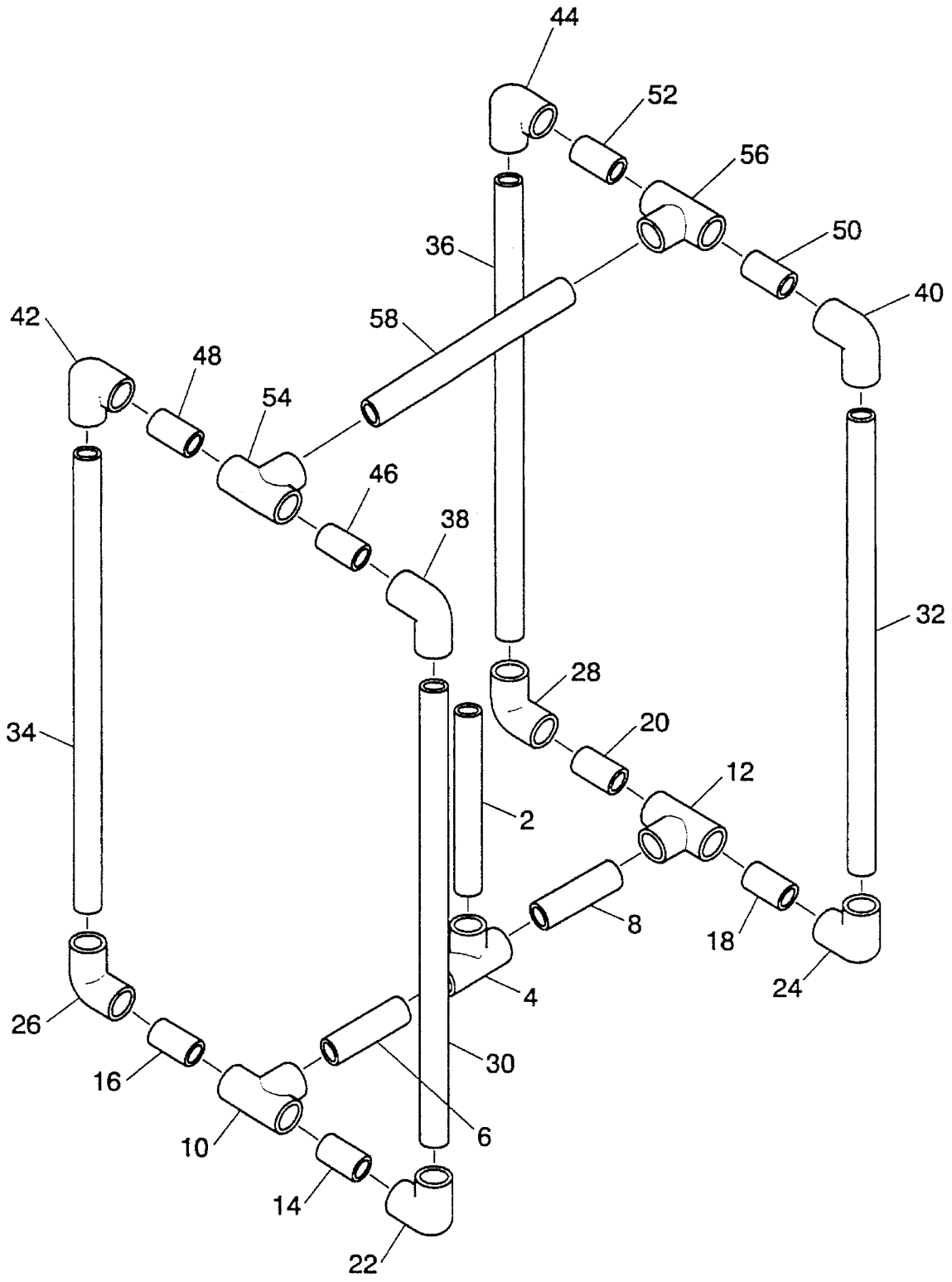
Fig. 1-C

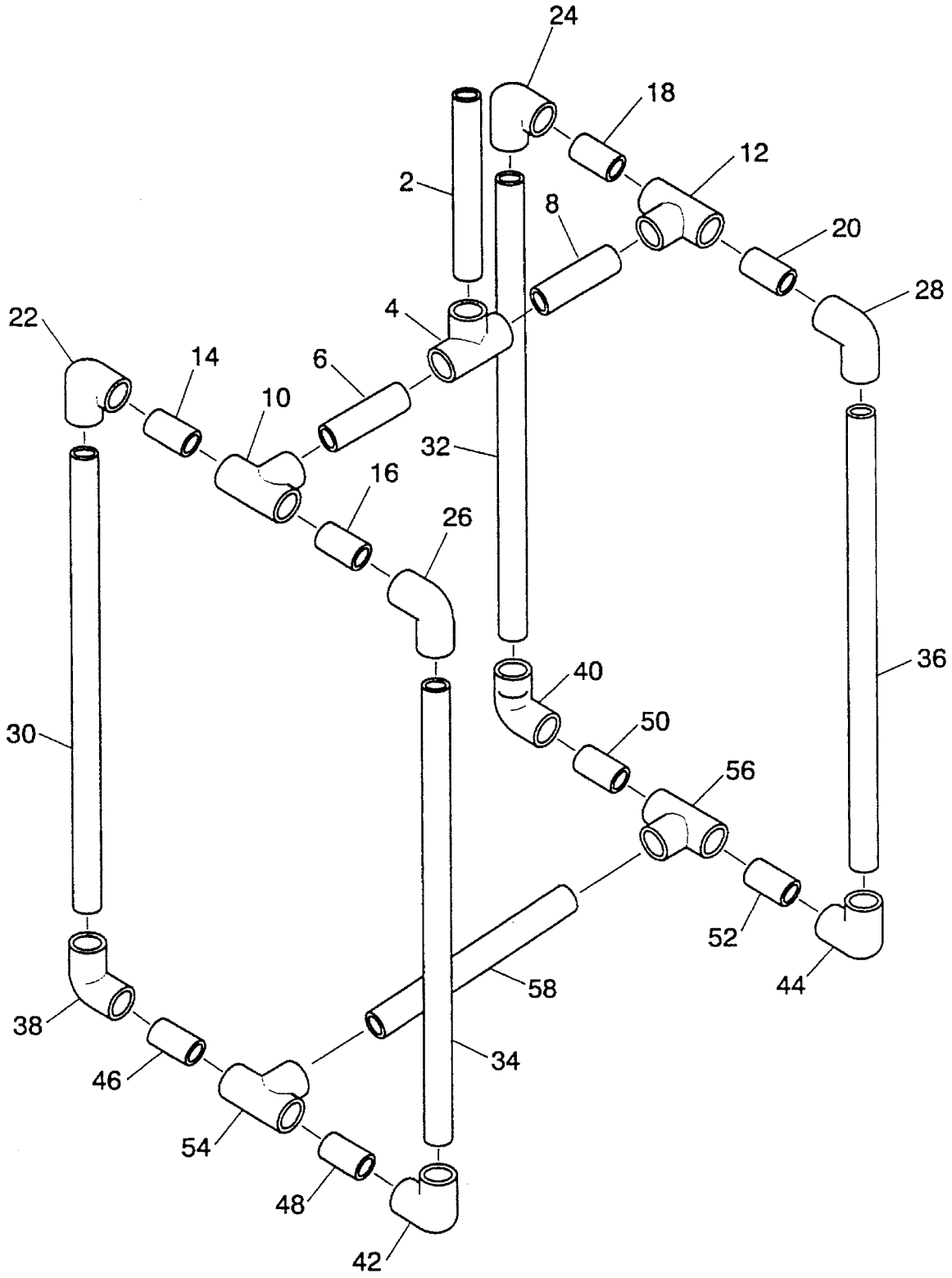
Fig. 1-D

PORTABLE-TRAVEL-STORAGE-STYLING WIG CAGE

BACKGROUND

1. Field of Invention

This invention relates to wigs, specifically to an improved method of travel, storage and styling of a wig.

2. Description of Prior Art

Wig hair stylists and their clients have always had the problems of transporting, and storing styled wigs. Wigs usually are stored on a head form and placed in a container. The wig must be placed gently in the container in such a manner as not to disturb the style. While traveling on an airplane, airlines insist that carryon baggage fit under the seat in front of you or fit in the overhead baggage compartment. Generally wig boxes are too large to accommodate this Federal regulation.

Wig hair stylists and their clients have had to find ways to style an unstyled wig. This has been accomplished in the past by styling the wig on the person, or styling the unstyled wig on a head form being secured by some method.

Thereafter inventors created different ways for transport, storage and styling of wigs. The state of the art invention in the mid 1960's U.S. Pat. No. 3,327,842 Meridith and Lende (1964) "Combination Wig Box and Styling Stand", was one of the first combination wig boxes and styling stands. The limitations of this invention are the inability to examine the contents of the box and the limitations for the types of wigs it can suitably store because of the fixed size of the invention.

U.S. Pat. No. 3,289,822 to Schumer (1965) Wig Or Wiglet Carrying Case was also one of the original wig cases for solving the problem of transport/storage. Disadvantages to this invention are: the unit does not allow for observation to examination of contents with out opening container, it doesn't fit under an airline seat or an overhead compartment bin, and it doesn't facilitate longer hair wigs adequately.

Then shortly there after U.S. Pat. No. 3,289,823 Weiser (1966) Wig Container was for storing a display head only for use in supporting a wig. Disadvantages: the invention was mainly for storing a manikin head form, and only small wigs with limited styles could be accommodated, even though the invention is called a "Wig Container." Styling of the wig difficulties were how to secure wig to base for styling.

A device that is still sold today is U.S. Pat. No. 3,603,489 to Fleischer (1970) "Device for storing wigs" is not suitable for transporting or the styling of wigs. The wig stored on the device is not secured to the stand.

Another device that was invented U.S. Pat. No. 3,658,174 to Friedman (1969) "Wig Form and Carrying Case" is limited to the size and styles the invention is able to accommodate. The device must be opened to observe the contents of the case.

A year later U.S. Pat. No. 3,740,014 to Bently and Wilson (1971) "Wig Tote" was a device for transporting a wig in a car This device had no protection from the environment of the car, like the windows open while driving. The device could also be fastened to furniture or wall limiting the portability of the invention.

That same year U.S. Pat. No. 3,713,566 to Perez (1971) "Wig Stand" was another device that stored wigs. The unit was not adequate for styling and the unit is not adequate for transport as the unit has no covering to protect the wig from environmental considerations.

That same year as well U.S. Pat. No. 3,750,869 to Kartiganer (1971) "Combination Carrying Case and Wig Stand" was a carrying case for the wig form only. The device was designed for holding a wig form and had limited space inside, thus holding limited types of styled wigs. The case had to be opened to examine the wig.

Then came U.S. Pat. No. 3,885,718 to Clemence (1974) "Portable Wigstand." This invention is limited to the number of styles it can adequately accommodate, can not be easily transported on public carriers, and unit must be opened to examine wig.

The following year U.S. Pat. No. 3,935,871 to Kern (1975) "Collapsible Wig Stand" a device for storing a wig only. The unit not suitable for transporting or styling a wig. The unit has no way of protecting a styled wig from environmental considerations.

Then in 1985 a device for storing hair pieces was invented. U.S. Pat. No. 4,616,747 to Zimmerman "Hair Piece Storage and Carrying Case" a storage device mainly for men. This unit is not adequate for styling, and the contents of the device can not be examined without opening.

Other prior art that has been found, U.S. Pat. No. 3,448,957 to Friedman (1967) "Wig Block Support" a C-clamp support with a swivel permitting selective orientation. This device requires a table or dresser top to clamp a C-clamp to secure support.

Sally Hunter came up with Headpiece support U.S. Pat. No. 3,464,603 (1968) a support clamp that must be clamped to existing table lamps. The storage of this is device temporary.

Schwartz and Voller invented a Collapsible Wig Stand U.S. Pat. No. 3,465,926 (1968). This is an inflatable portable stand that would not hold a wig secure for styling.

U S. Pat. No. 3,465,927 to Belokin (1967) This invention is another collapsible wig stand that is good for temporary storage and is also an air inflatable stand that does not hold a wig secure for styling.

A revision on Friedman's invention U.S. Pat. No. 3,489,383 to Anson (1968) was "Swivel Support For A Mannequin Head" This device is a somewhat more flexible invention, however the device still requires a table or dresser for the C-clamp to hold the invention stationary.

A Wig Head Stand was invented by Rouleau U.S. Pat. No. 3,503,581 (1967) This device was held between the legs of the person styling the wig on a head form. This invention was primarily used for styling only.

Other prior art wig stands and mounts for head forms found:

- U.S. Pat. No. 3,515,318to Preble (1969) Collapsible wig stand Forming It's Own Case
- U.S. Pat. No. 3,580,437 to Luco (1970) Demountable Wig Stand
- U.S. Pat. No. 3,596,863 to Kaspareck (1969) Fine Adjustments Mount
- U.S. Pat. No. 3,615,046 to Bashara (1970) Wig Stand
- U.S. Pat. No. 3,658,283 to Martin (1969) Extendible Wig Rack
- U.S. Pat. No. 3,741,448 to Friedman ((1971)Collapsible Wig Stand
- U.S. Pat. No. 3,934,804 to Bruce (1975) Support For Mannequin Heads
- U.S. Pat. No. 4,422,230 to Nemoto (1981) Good For Producing Workbench For A Wig
- U.S. Pat. No. 4,470,528 to Renee La ((1983) Telescoping Shaft Equipped Wig Mount Theses patents were for use in styling a wig on a confining and limited area where wig stand had to be fastened to a table top. Wig stands were for temporary storage only and were similar to other described inventions.

OBJECTS AND ADVANTAGES

Accordingly, besides the objects and advantages of the travel-storage-styling wig cage in my above patent, many objects and advantages of the present invention are:

(a) to provide safe and effective transportation of a styled or unstyled wig on public or private carriers.

(b) to provide easy, safe and effective travel or storage at home or any other location of a styled or unstyled wig with the ability to observe the appearance of the wig without having to open a container.

(c) to be able to style a wig with out having to remove the head form from its support.

(e) that the contents can be protected from the elements by covering the device with a light weight flexible transparent waterproof cover during storage and/or transportation.

(f) that the handle is an integral part of the unit.

(g) that the unit is easily assembled and/or disassembled for storage and/or shipping.

(h) custom modification in dimensions may be easily accomplished to accommodate the specific requirements of the purchaser.

(i) assembly of the unit requires no special tools, skills or materials as the unit is held together by friction coupling, and which also can be made permanent if necessary. Individual pieces of the unit may be color coded, as necessary for ease in assembly.

Further objects and advantages are that the unit is safe, light, strong, convenient and easily manipulated. Still further objects and advantages will become apparent from consideration of the ensuing description and drawings.

DRAWING FIGURES

In the drawings, closely related figures have the same number but different alphabetic suffixes.

FIG. 1-A shows a perspective view of my invention in the travel and storage position. You will observe the head form resting on vertical neck lever (2). The head form shown is an inexpensive commonly purchased styrofoam head form that a long or short haired wig would rest on.

FIG. 1-B shows a perspective view of my invention in the styling position. You will observe a styrofoam head form resting on a vertical neck lever (2) in the upright styling position. A phantom view showing where the head form was prior as shown in FIG. 1-A is demonstrated.

FIG. 1-C shows an exploded view of interconnecting parts. My invention is now viewed in the travel and storage position with vertical neck lever (2) in the down position at the bottom of the cage.

FIG. 1-D shows an exploded view of interconnecting parts. My invention is now viewed in the styling position with vertical neck lever (2) in the up position on top of the cage.

| Reference Numerals In Drawings | |
|---|---|
| 2 Vertical Neck | 4 Horizontal Swivel |

-continued

| Reference Numerals In Drawings | |
|---|---|
| Lever | "T" Joint |
| 6 Horizontal Swivel Rod (A) | 8 Horizontal Swivel Rod (B) |
| 10 Horizontal Pivot "T" Joint (A) | 12 Horizontal Pivot "T" Joint (B) |
| 14 Horizontal Supporting Length (A) | 16 Horizontal Supporting Length (B) |
| 18 Horizontal Supporting Length (C) | 20 Horizontal Supporting Length (D) |
| 22 Corner Frame Support (A) | 24 Corner Frame Support (B) |
| 26 Corner Frame Support (C) | 28 Corner Frame Support (D) |
| 30 Vertical Frame Support (A) | 32 Vertical Frame Support (B) |
| 34 Vertical Frame Support (C) | 36 Vertical Frame Support (D) |
| 38 Corner Frame Support (E) | 40 Corner Frame Support (F) |
| 42 Corner Frame Support (G) | 44 Corner Frame Support (H) |
| 46 Horizontal Supporting Length (E) | 48 Horizontal Supporting Length (F) |
| 50 Horizontal Supporting Length (G) | 52 Horizontal Supporting Length (H) |
| 54 Horizontal "T" Receptacle (A) | 56 Horizontal "T" Receptacle (B) |
| 58 Horizontal Supporting Carrying Handle | |

DESCRIPTION-FIGS. 1-A TO 1-D

FIG. 1-A shows a perspective view of my Travel/Storage and Styling Wig Cage in the travel and storage position showing an inexpensively purchased styrofoam head form resting on a vertical neck lever (2). Construction of this device is made from commonly purchased ¾" Schedule 40 P.V.C. pipe, 90 degree elbows and "T" joints. All joints are held together by friction coupling to facilitate ease of assembly, shipping, and storage. All joints can be made permanent by using an adhesive for plastics. This invention can also be manufactured with different dimensions and substitute other materials such as metals, woods, or other plastics etc.

A Vertical neck lever (2) is inserted into top coupling of Horizontal Swivel "T" Joint (4). Horizontal Swivel Rods (A) (6) and (B) (8) are inserted into ends of Horizontal Swivel "T" Joint (4). Ends of Horizontal Swivel Rods (A) (6) and (B) (8) are then inserted into sides of Horizontal Pivot "T" Joints (A) (10) and (B) (12).

Horizontal supporting Lengths (A) (14), (B) (16), (C) (18) and (D) (20) are inserted into ends of Horizontal Pivot "T" Joints (A) (10) and (B) (12). Corner Frame Supports end couplings (A) (22), (B) (24), (C) (26) and (D) (28) are coupled to Horizontal Supporting Lengths (A) (14), (B) (16), (C) (18) and (D) (20) and said Corner Frame Supports are oriented vertically. Vertical Frame Supports (A) (30), (B) (32), (C) (34), and (D) (36) are inserted into vertically oriented end couplings of Corner Frame Supports (A) (22), (B) (24), (C) (26) and (D) (28). End couplings of Corner Frame Supports (E) (38), (F) (40), (G) (42) and (H) (44) are coupled to Vertical Frame Supports (A) (30), (B) (32), (C) (34) and (D) (36). Corner Frame Supports (E) (38), (F) (40), (G) (42) and (H) (44) are oriented parallel to that of bottom Corner Frame Supports (A) (22), (B) (24), (C) (26) and (D) (28). Horizontal Supporting Lengths (E) (46), (F) (48), (G) (50) and (H) (52) are inserted into Corner Frame Supports (E) (38), (F) (40), (G) (42) and (H) (44) end couplings. End couplings of Horizontal "T" Receptacles (A) (54) and (B) (56) are coupled to Horizontal Supporting Lengths (E) (46), (F) (48), (G) (50) and (H) (52). Horizontal Supporting Carrying Handle (58) ends are inserted into center couplings of Horizontal "T" Receptacles (A) (54) and (B) (56).

Joints are held together with friction coupling. Pressure is exerted on all sides of cage to ensure tight secure joints.

FIG. 1-B shows a perspective view of my Wig Cage invention now in the Styling position. Note that the head form is now on top of the cage from a position shown as phantom on the bottom of cage. The cage has been rotated 180 degrees with Horizontal Supporting Carrying Handle (58) now at the bottom of the cage. Please note reference numerals in FIG. 1-B have not changed, only reference numerals position have changed.

FIG. 1-C shows an exploded view of my invention in the travel and storage position. A person can easily construct this invention by merely looking at this drawing closely. Dimensions of Vertical Frame Supports (A-D) (30–36) and Horizontal Supporting Lengths (A-D) (14–20) and (E-H) (46–52) change by the required space to accommodate a long haired or short haired wig.

FIG. 1-D also shows an exploded view of my invention in the Styling position. Note that vertical neck lever (2) is on top of cage, and Horizontal Carrying Handle (58) is at bottom of cage. The cage again has been rotated 180 degrees and vertical neck lever (2) swiveled 180 degrees also.

OPERATION-FIGS. 1-A, 1-B, 1-C, AND 1-D

The Travel, Storage and Styling Wig Cage is truly a unique invention. It was one of those situations where necessity was "the Mother of Invention."

The device is comprised of commonly purchased ¾" Schedule 40 P.V.C. pipe, 90 degree elbows and "T" joints, all easily purchased where ever hardware and gardening supplies are sold.

The device is manipulated by means of an adjustable vertical neck lever that pivots on two horizontal pivot rods and two ¾" "T" joints where the center coupling acts as a swivel point for the vertical neck lever. The end couplings of these two swivel "T" joints become the basis for which the frame work of the cage is configured.

The cage is configured by means of different lengths of hollow straight ¾" P.V.C. pipe, eight corner frame supports (¾" 90 degree elbows), and four ¾" "T" joints.

The Travel, Storage and styling wig cage is held together by friction coupling. P.V.C. pipe, elbows and "T" fit together snugly. Permanent assembly is also easily accomplished by means of a plastic cement applied to coupling joints.

Once the cage is configured for specific requirement . . . say for very long haired wig that hangs long, a styled or unstyled wig is easily transported and or stored inside the cage. A protective covering over the cage such as an ordinary inexpensive tall kitchen plastic trash bag or clear transparent plastic garment bag from dry cleaners can be used to keep environment elements from damaging a styled or unstyled wig. A custom bag or covering is also easily fabricated so as to fulfil consumers needs.

If a person wants to remove the wig from the cage, this is easily accomplished by holding the vertical neck lever (2) and rotating the cage 180 degrees. The wig cage will be rotated backward or forward while the vertical neck lever (2) and the head form holding wig while the wig cage rotates on its pivot points. The head form holding wig now sits on top of cage, and now the wig cage has become a convenient base and sturdy stand for which the wig can now be removed or easily styled.

The height of the cage for an extra long wig is approximately 24 inches plus the length of vertical neck lever and head form. Styling is easily accomplished while sitting as height of the wig is at arms reach. If one wishes to stand while styling, the wig cage may be conveniently placed on a chair for an ideal height for styling while a person stands. The cage can also be easily reconfigured as a permanent sturdy styling stand.

If a person wants to travel on an airplane and take their wigs along, the wig cage is easily reconfigured so as to fit in a suitcase or a flight bag. Federal regulations mandate that all carry on luggage fit under seat in front of you or in the overhead storage compartment. Two long haired wigs can easily be stored in a carry on flight bag, or be easily stored overhead in the storage compartment. A flight bag containing two extra long haired wigs in wig cages may also be checked as baggage or luggage. Two beautifully styled wigs will be protected in a wig cage as they are transported.

Because consumers of this device have different needs and changing requirements for a wig cage, all swivel rods, supporting lengths, supporting carrying handle lengths and vertical frame supports dimensions are easily altered. A Travel, Storage and Styling Wig Cage is very flexible to accommodate specifications of whatever a person using this device may need.

SUMMARY, RAMIFICATIONS, AND SCOPE

Accordingly, there are many advantages to my invention, The Travel, Storage, and Styling Wig Cage. The reader will see that by the following examples:

- it provide safe and effective transportation of a styled or unstyled wig on public or private carriers;
- it provide easy, safe and effective travel or storage at home or any other location of a styled or unstyled wig with the ability to observe the appearance of the wig without having to open a container;
- it enables one to style a wig without having to remove a head form from its support;
- that the contents can be protected from the elements by covering the device with a light weight flexible transparent waterproof cover during transportation and/or storage;
- that the handle is an integral part of the unit;
- that the unit is easily assembled and/or disassembled for storage and/or shipping;
- that custom modifications in various dimensions may be easily accomplished to accommodate user requirements;
- that assembly of the device requires no special tools, skills or materials as the unit is held together by friction coupling, and which can be made permanent if necessary;
- that the unit is safe, light, strong, convenient and easily manipulated Although the description above contains many specificities, these should not be construed as limiting the scope of the invention but as merely providing illustrations of some of the presently preferred embodiments of this invention. For example, the frame could be made of other materials such as metals, woods or other plastics. Parts of the device could be color coded for ease of assembly. The frame of the wig cage frame could be permanently fabricated in mass production with no interchangeable parts if desired.

Thus the scope of the invention should be determined by the appended claims and their legal equivalents, rather than by the examples given.

I claim:

1. A portable cage device for transport, storage, and styling of wigs comprising:

a) a vertical neck lever supporting a head mannequin, b) a horizonal pivot tee joint with end and center couplings, c) a plurality of horizontal swivel rods connected to said horizonal pivot tee joint, d) second and third horizontal tee joints each with end and center couplings attached to the swivel rods, e) a plurality of horizontal supporting lengths connected to the second and third horizontal tee joints, f) a plurality of corner frame supports with end couplings connected to the horizontal supporting lengths, g) a plurality of vertical frame supports connected to the corner frame supports h) fourth and fifth horizontal pivot tee joints with end and center couplings connected to the vertical supports by additional corner frame supports with end couplings, i) a horizontal supporting carrying handle supported between the fourth and fifth horizontal pivot tee joints, wherein the assembled cage structure enables a person to transport and store a wig on the head mannequin and to rotate the neck lever and head mannequin 180 degrees to style a wig there upon.

* * * * *